US005755645A

United States Patent [19]

Miller et al.

[11] Patent Number: 5,755,645

[45] Date of Patent: May 26, 1998

[54] EXERCISE APPARATUS

[75] Inventors: Larry C. Miller, Wellesley, Mass.; Nathan Ulrich, Lee, N.H.; William T. Townsend, Weston, Mass.; Dana Yoerger, N. Falmouth, Mass.; Yoky Matsuoka, Cambridge, Mass.; Brandon D. Larocque, Belmont, Mass.

[73] Assignee: Boston Biomotion, Inc., Wellesley, Mass.

[21] Appl. No.: 780,650

[22] Filed: Jan. 9, 1997

[51] Int. Cl.[6] ..... S63B 21/005

[52] U.S. Cl. ..... 482/115; 482/5; 482/120; 482/903

[58] Field of Search ..... 482/5–7, 9, 112, 482/113, 114, 115, 118, 133, 139, 903, 120; 623/24; 601/5, 33, 34

[56] References Cited

U.S. PATENT DOCUMENTS

| | | | |
|---|---|---|---|
| 2,139,166 | 12/1938 | Leuchter | 128/25 |
| 3,465,592 | 9/1969 | Perrine | 73/379 |
| 4,235,437 | 11/1980 | Ruis et al. | 482/5 |
| 4,258,913 | 3/1981 | Brentham . | |
| 4,261,562 | 4/1981 | Flavell . | |

(List continued on next page.)

FOREIGN PATENT DOCUMENTS

| | | |
|---|---|---|
| 2 541 574 | 8/1984 | France . |
| 2 624 002 | 6/1989 | France . |

OTHER PUBLICATIONS

Maxwell, S. M., "A Modulated–Energy–Dissipation Manipulator and Application to Suppressing Human Arm Tremor," submitted to the Dept. of Mechanical Engineering at the Mass. Inst. of Tech., pp. 1–296 (Jun., 1990).

Photos of force reflecting hand controller for teleoperation at the JET Propulsion laboratory, at least by 1988.

"Arcuate™ Technology by Pacific Fitness—Creating a New Generation of Fitness Equipment," brochure by Pacific Fitness Corporation, 5 pages (Mar. 1995).

Paul, Richard P., "Robot Manipulators," MIT Press, 3 pages, 1981.

Rosen, M. L. and Adelstein, B. D., "Design of a Two–Degree–of–Freedom Manipulandum for Tremor Research," *IEEE Frontiers of Engineering and Computing in Health Care*, pp. 47–51 (1984).

McKerrow, J. P., "Introduction to Robotics," Addison–Wesley, p. 82 (1991).

Spong, Mark W., Vidysagar, M., "Robot Dynamics and Control," Wiley, pp. 8–13 (1989).

Klafter, R. D., Chmielewski, T. A., Negin, M., "Robotic Engineering, An Integrated Approach," pp. 4 and 6, Prentice–Hall (1989).

Asada, H., Slotine, J.J.E., "Robot Analysis and Control," pp. 36–37, Wiley (1986).

Palmitier, R.A., et al., "Kinetic Chain Exercise in Knee Rehabilitation," *Sports Medicine 11*, pp. 402–413 (1991).

*Primary Examiner*—Richard J. Apley
*Assistant Examiner*—John Mulcahy
*Attorney, Agent, or Firm*—Hamilton, Brook, Smith & Reynolds, P.C.

[57] ABSTRACT

A passive exercise apparatus includes an interface member for coupling to a user's limb. An arm member is coupled to the interface member by a wrist joint. The wrist joint has rotational motion about three axes. A first link is coupled to the arm member by a sliding joint. The sliding joint allows translational motion of the arm member relative to the first link. A second link is rotatably coupled to the first link by a first rotary joint. A third link is rotatably coupled to the second link by a second rotary joint. A first brake is coupled to the first rotary joint for resisting movement of the first rotary joint. A second brake is coupled to the second rotary joint for resisting movement of the second rotary joint. A third brake is coupled to the arm member for resisting movement of the arm member. The user is capable of interfacing with the apparatus to exercise a six degree of freedom motion.

19 Claims, 10 Drawing Sheets

U.S. PATENT DOCUMENTS

| | | | |
|---|---|---|---|
| 4,263,915 | 4/1981 | McDonald et al. | 128/419 |
| 4,354,676 | 10/1982 | Ariel . | |
| 4,478,412 | 10/1984 | Muir . | |
| 4,544,154 | 10/1985 | Ariel . | |
| 4,577,862 | 3/1986 | Sagedahl . | |
| 4,592,545 | 6/1986 | Sagedahl et al. . | |
| 4,620,703 | 11/1986 | Greenhut | 482/903 X |
| 4,628,185 | 12/1986 | Amann | 482/113 |
| 4,872,668 | 10/1989 | McGillis et al. | 482/5 X |
| 4,979,733 | 12/1990 | Prud'Hon . | |
| 5,042,799 | 8/1991 | Stanley . | |
| 5,072,932 | 12/1991 | Johnson . | |
| 5,163,451 | 11/1992 | Grellas | 128/898 |
| 5,193,963 | 3/1993 | McAffee et al. | 414/5 |
| 5,201,772 | 4/1993 | Maxwell | 482/903 X |
| 5,231,998 | 8/1993 | Rosen et al. | 128/878 |
| 5,242,344 | 9/1993 | Hundley | 482/93 |
| 5,244,441 | 9/1993 | Dempster et al. | 482/9 |
| 5,250,016 | 10/1993 | Higgins | 482/121 |
| 5,254,066 | 10/1993 | Brown et al. | 482/137 |
| 5,263,382 | 11/1993 | Brooks et al. | 74/471 X |
| 5,277,681 | 1/1994 | Holt | 482/112 |
| 5,284,464 | 2/1994 | Lee, III et al. | 482/121 |
| 5,286,243 | 2/1994 | Lapcevic | 482/97 |
| 5,314,390 | 5/1994 | Westing et al. | 482/6 |
| 5,324,247 | 6/1994 | Lepley | 482/134 |
| 5,354,251 | 10/1994 | Sleamaker | 482/96 |
| 5,356,353 | 10/1994 | Takaoka | 482/9 |
| 5,362,298 | 11/1994 | Brown et al. | 482/137 |
| 5,368,546 | 11/1994 | Stark et al. | 601/34 |
| 5,393,280 | 2/1995 | Haviv | 482/56 |
| 5,399,951 | 3/1995 | Lavallee et al. | 318/567 |
| 5,409,435 | 4/1995 | Daniels | 482/5 |
| 5,410,472 | 4/1995 | Anderson | 364/413.04 |
| 5,413,546 | 5/1995 | Basile | 482/99 |
| 5,466,213 | 11/1995 | Hogan et al. | 601/33 |
| 5,476,441 | 12/1995 | Durfee et al. | 602/23 |

EXERCISE APPARATUS

BACKGROUND

Most machines for exercising or rehabilitating muscles and joints (for example, the machines commonly found in health clubs) are designed to exercise only one particular body motion. Such machines typically provide resistance in only one degree of freedom and are not capable of exercising complex functional motions such as throwing a ball or swinging a baseball bat since such complex functional motions have movement in several degrees of freedom. In order to exercise complex functional motions in a realistic manner, an exercise machine is needed which provides resistance and movement in more than one degree of freedom.

SUMMARY OF THE INVENTION

The present invention provides a passive exercise apparatus including an interface member for coupling to a user's body (usually to a limb). The exercise apparatus has an arm member which is coupled to the interface member by a wrist joint. The wrist joint is a gimbal joint allowing rotational motion about three axes. A first link is coupled to the arm member by a sliding joint. The sliding joint allows translational motion of the arm member relative to the first link. A second link is rotatably coupled to the first link by a first rotary joint. A third link is rotatably coupled to the second link by a second rotary joint. A first brake is coupled to the first rotary joint for resisting movement of the first rotary joint. A second brake is coupled to the second rotary joint for resisting movement of the second rotary joint. A third brake is coupled to the arm member for resisting movement of the arm member relative to the first link. The user is capable of interfacing with the apparatus to exercise a six degree of freedom motion.

In preferred embodiments, the wrist joint is unbraked. First, second and third transmissions couple the first joint, the second joint and the arm member to the first, second and third brakes, respectively, for reducing torque to the brakes. The first and second transmissions are two stage cable drives having torque reduction ratios of about 30:1 or greater. The second transmission includes at least one horizontally oriented pulley for engaging a cable. The pulley has a wire encircling the pulley for vertically supporting the cable to prevent the cable from slipping off the pulley. The third transmission includes a cable secured to the arm member which engages a pulley rotatably coupled to the third brake. First, second and third sensors are included for sensing movement of the first rotary joint, the second rotary joint and the arm member, respectively. The amount of resistance provided by the first, second and third brakes is proportional to the movement sensed by the sensors.

In use, the user moves the interface member within a three dimensional resistance field while exercising. The resistance field is capable of being programmed to include first and second resistance areas where the level of resistance provided by the first area differs from the level of resistance provided by the second area. The shape of the first and second resistance areas as well as the level of resistance can be programmably varied.

The present invention provides an exercise apparatus having a relatively simple linkage arrangement and a minimum number of brakes which allows a user to exercise most functional motions having six degrees of freedom. The low number of components allows the exercise apparatus to be relatively inexpensive for an apparatus having such capabilities. In addition, the present invention exercise apparatus is safe to use since it is a passive exercise apparatus and there is no danger of the user being injured by actively moving members.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
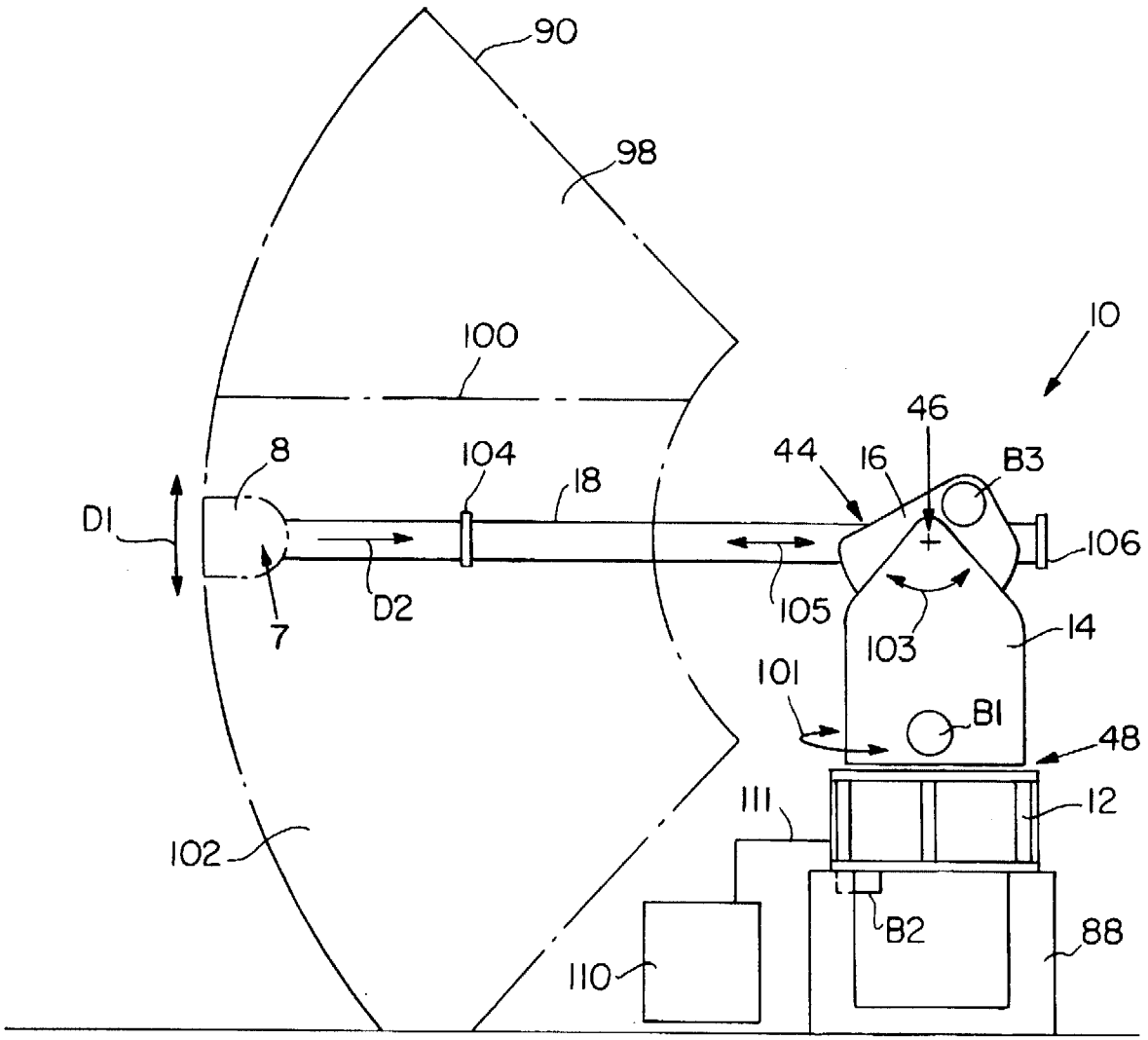
FIG. 1 is a side view of the present invention exercise apparatus.
Figure 2:
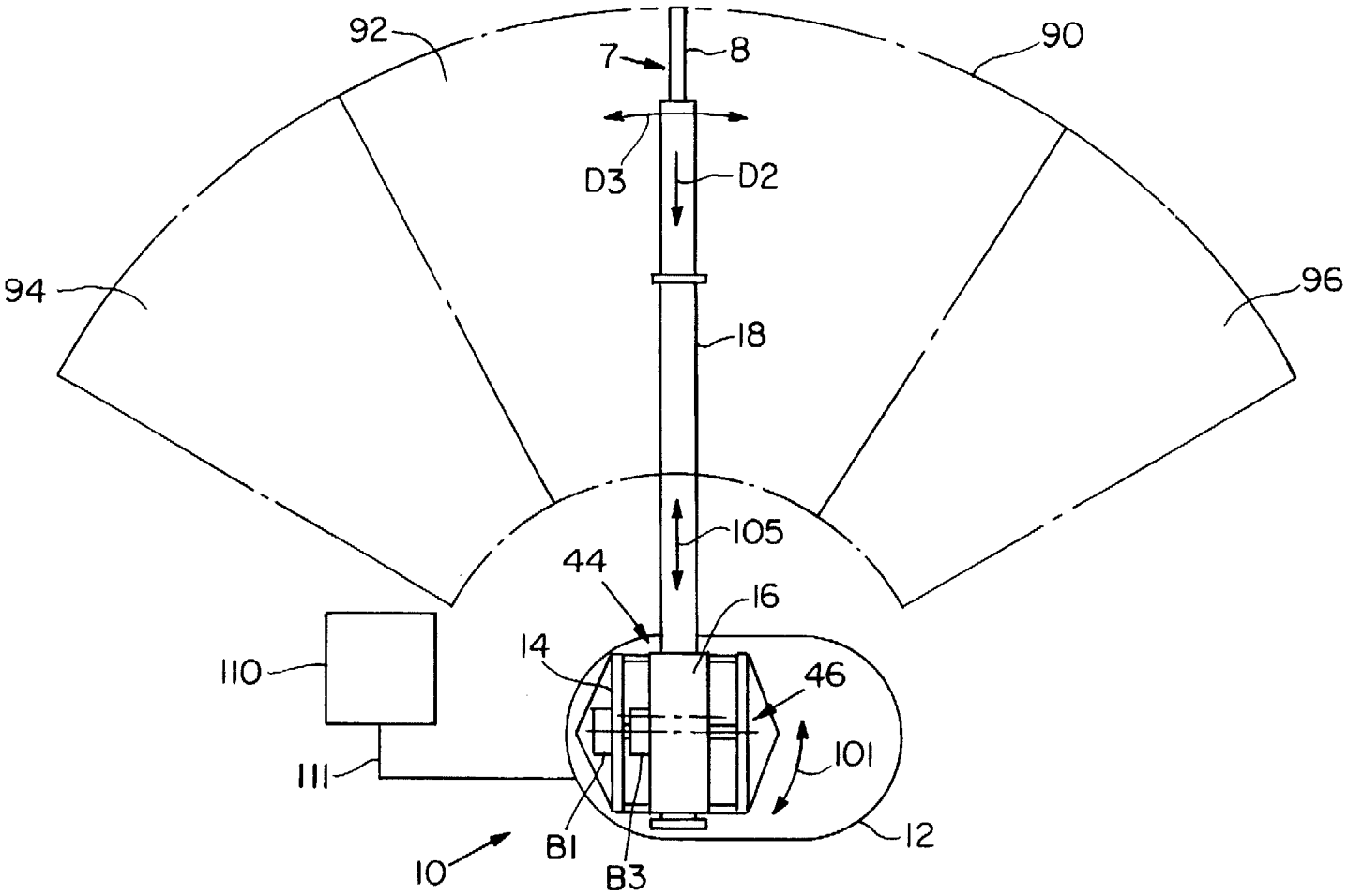
FIG. 2 is a plan view of the present invention exercise apparatus.
Figure 6:
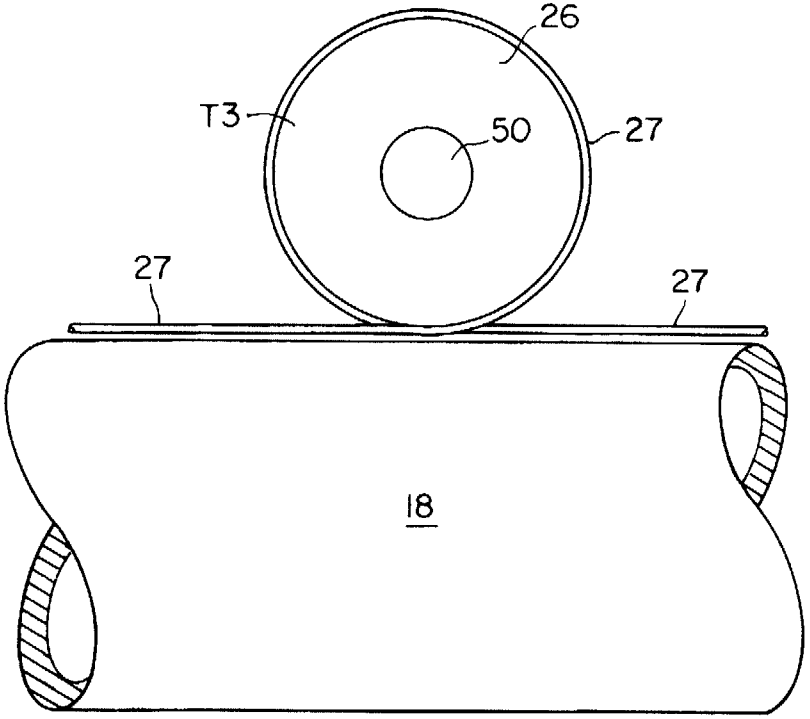
FIG. 6 is a side view of the cabling arrangement for the arm member.

Referring to FIGS. 1 and 2, exercise apparatus 10 includes a limb interface 8 which is coupled to the distal end of a tubular arm member 18 by a wrist joint (generally indicated by reference numeral 7 in FIG. 3) having three rotational degrees of freedom. Limb interface 8 has a handle 126 (FIG. 3) which a user grips with his/her hand. Arm member 18 is coupled to and slides relative to a shoulder member 16 along a linear sliding joint 44. Shoulder member 16 is rotatably coupled to a turret 14 by a rotary shoulder joint 46. Rotary shoulder joint 46 allows arm member 18 and shoulder member 16 to pivot up and down relative to the ground. Turret 14 is rotatably coupled to a base 12 by a rotary waist joint 48. Rotary waist joint allows arm member 18 to be swung horizontally relative to the ground. Base 12 is supported by a stand 88 which raises exercise apparatus 10 to a height suitable for use by an adult.

Figure 4:
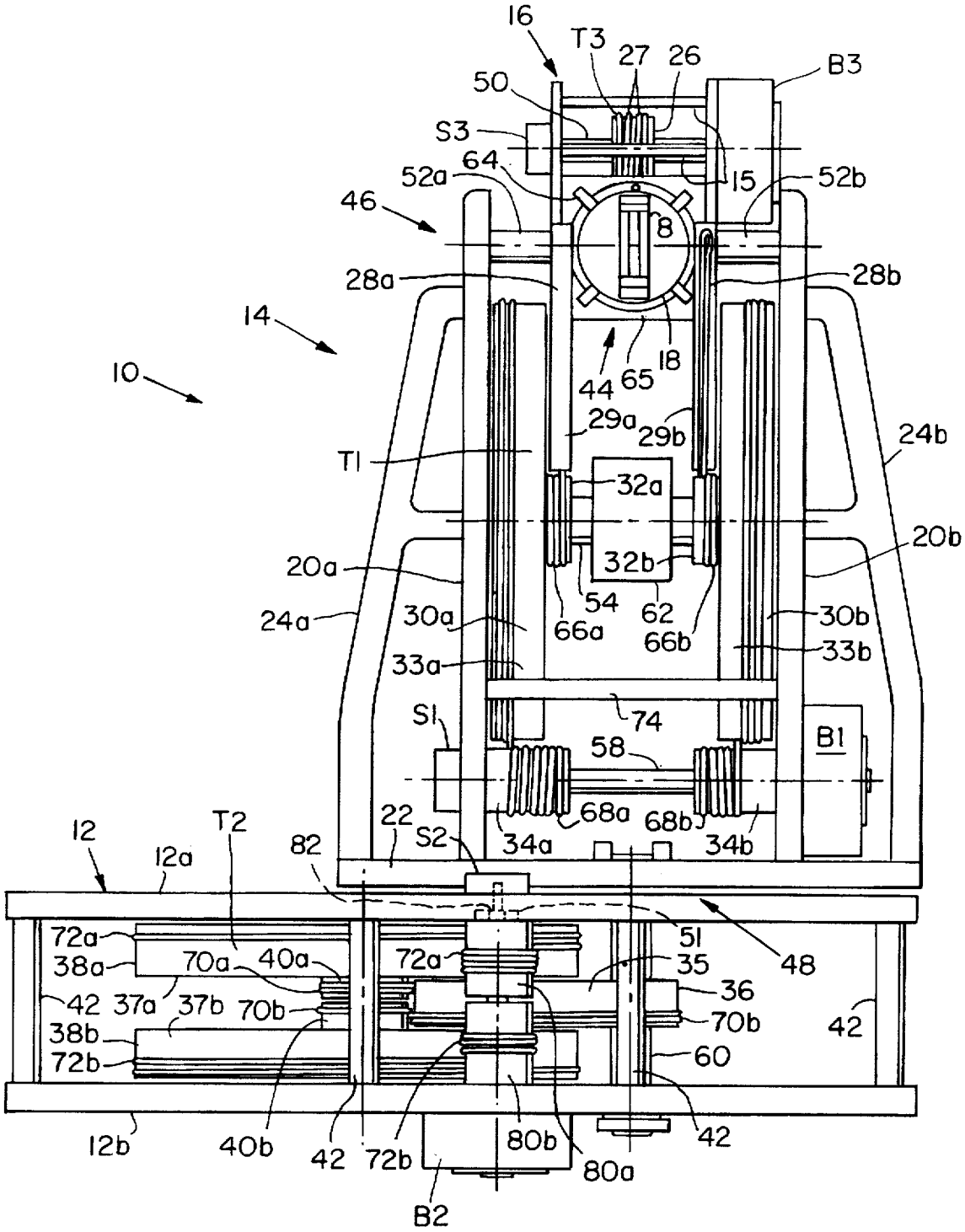
FIG. 4 is a front view of the present invention exercise apparatus.
Figure 5:
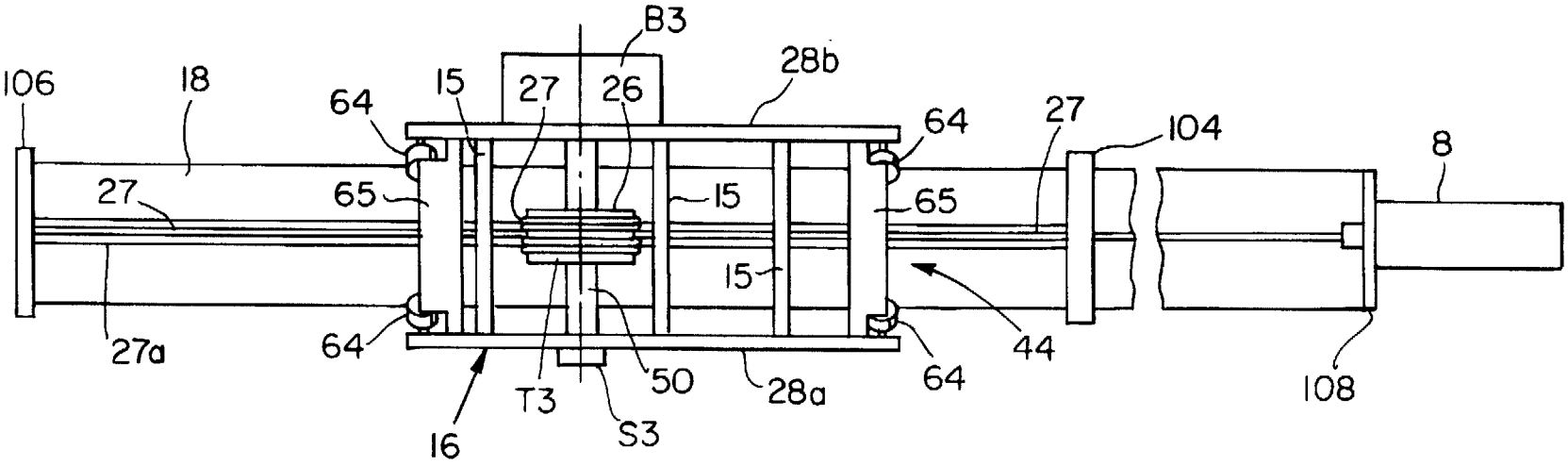
FIG. 5 is a top view of the arm member and sliding joint arrangement.

Rotational movement of rotary shoulder joint 46 (indicated by arrows 103) is controllably resisted by a brake B1 which is coupled to rotary shoulder joint 46 by a transmission T1 as seen in FIG. 4. Rotational movement of rotary waist joint 48 (indicated by arrows 101) is controllably resisted by a brake B2 which is coupled to rotary waist joint 48 by a transmission T2. Linear movement of arm member 18 relative to shoulder member 16 along sliding joint 44 (indicated by arrows 105) is controllably resisted by a brake B3 which is coupled to arm member 18 by a transmission T3. Brakes B1, B2 and B3 are preferably magnetic particle brakes which provide a maximum torque of 17 N-M but, alternatively, can be induction or disc brakes. Transmissions T1, T2 and T3 reduce the amount of torque that is transmitted to brakes B1, B2 and B3. Transmissions T1, T2 and T3 are preferably cable drive transmissions having low friction and zero backlash, but, alternatively, other transmissions can be employed such as gear trains or belt drives. Transmissions T1 and T2 preferably provide at least about a 30 to 1 torque reduction ratio. The amount of resistance provided by brakes B1, B2 and B3 is controlled by a computer 110 which communicates with brakes B1, B2 and B3 by a communication line 111.

During use, the amount of resistance provided by brakes B1, B2 and B3 is determined by the speed at which joints 44, 46 and 48 move. The faster joints 44, 46 and 48 move, the greater the resistance brakes B1, B2 and B3 provide. This is known as viscous damping. Each joint 44, 46 and 48 is provided with equal amounts of resistance. A series of sensors S1, S2 and S3 (FIG. 4) indirectly sense the speed at which joints 44, 46 and 48 move by sensing the rotational displacement of brake shafts 58, 82 and 50 of respective brakes B1, B2 and B3. Computer 110 uses this information to determine the appropriate amount of resistance that brakes B1, B2 and B3 should provide and then controls the resistance of brakes B1, B2 and B3 appropriately. Sensors S1, S2 and S3 are preferably optical encoders, but, alternatively, can be other types of sensors such as potentiometers or resolvers.

In use, a user grasping limb interface 8 can move limb interface 8 in the directions indicated by arrows D1, D2 and D3 in a spherical configuration anywhere within the three dimensional resistance field 90 to exercise a full functional motion. Although exercise apparatus 10 only has three degrees of freedom which are braked, the user can exercise a six degree of freedom motion. By making modifications to limb interface 8, a user can exercise virtually any functional motion, for example, rowing, swimming, pitching, hitting a baseball or hitting a tennis ball, etc. Such specificity in training can increase an athlete's performance as well as help reduce injuries. The faster the user moves limb interface 8 within resistance field 90, the greater the resistance that is provided by exercise apparatus 10. The movement of the user's hand is resisted by exercise apparatus 10 in a direction directly opposite to such movement at any point along the path of movement. This guarantees force velocity colinearity resulting in a natural feeling cause and effect motion.

Computer 110 can be programmed to provide resistance field 90 with separate areas of varying resistance. In this manner, the user can control the workspace providing resistance where it is desired. For example, in FIG. 1, dividing line 100 divides resistance field 90 into two resistance areas 98 and 102. Resistance area 98 provides a different amount of resistance than resistance area 102. Such an arrangement can be employed to simulate, for example, the waterline for exercising swimming or rowing motions. Referring to FIG. 2, resistance field 90 is divided into three different resistance areas 94, 92 and 96 as an example of another configuration of resistance areas. In other preferred embodiments, resistance areas can be employed to help guide a user through a desired motion, for example, a throwing motion. In such a case, one resistance area is shaped to have the path of the throwing motion and has less resistance than the surrounding resistance areas which thus helps passively guide the user along the desired motion. If desired, multiple resistance areas can be employed to simulate actual conditions.

Figure 3:
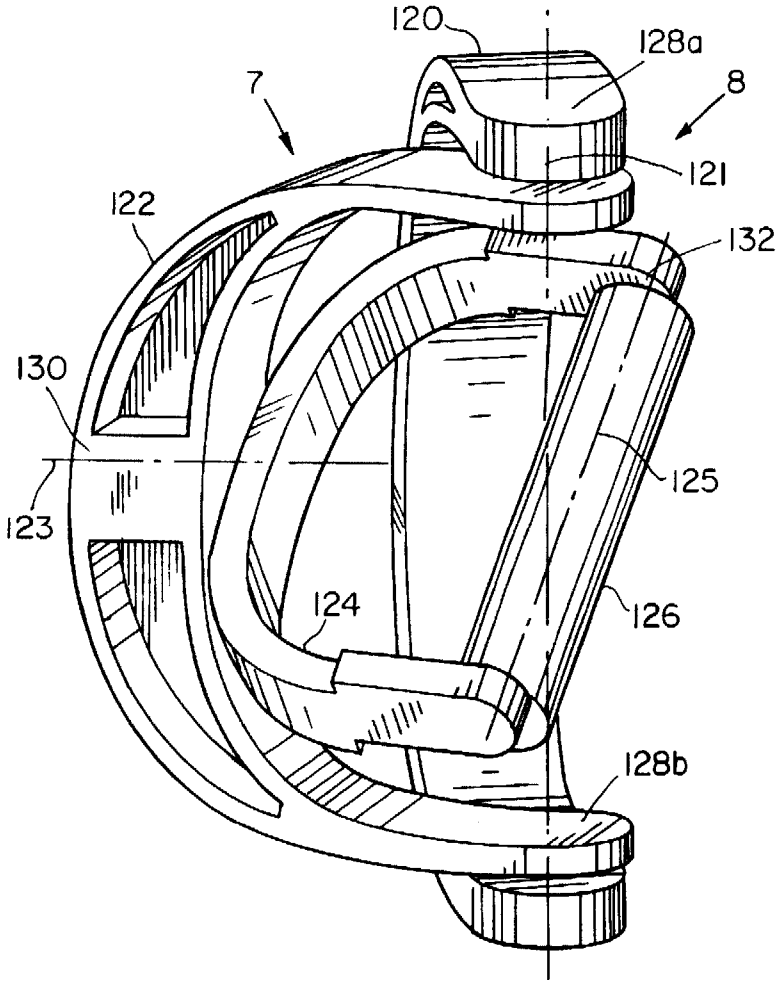
FIG. 3 is a perspective view of a preferred limb interface.

A more detailed description of exercise apparatus 10 now follows. Referring to FIG. 3, limb interface 8 includes an outer yoke 120 which is secured to the distal end of arm member 18. An intermediate yoke 122 is rotatably mounted to outer yoke 120 along an axis 121 by rotary joints **128*a* and 128*b*. An inner yoke 124 is rotatably mounted to intermediate yoke 122 along an axis 123 by rotary joint 130. Axis 123 is preferably orthogonal to axis 121. Gripping handle 126 is rotatably mounted to inner yoke 124 along an axis 125 by rotary joint 132. This configuration provides limb interface 8 with a gimbal joint 7 having three unbraked rotational degrees of freedom. The gimbal joint 7 allows the user's hand to be comfortably oriented at almost any position relative to exercise apparatus 10** during use.

Referring to FIGS. 4, 5, 6, and 7. Limb interface 8 is secured to arm member 18 by an end plate 108. Arm member 18 is an elongate tubular member that is preferably about 4" in diameter and 80" long. Although arm member 18 preferably has a round cross section and is completely hollow, alternatively, arm member 18 can have other suitable cross sections such as polygonal or oval cross sections and can have internal structural supports.

Sliding joint 44 includes two bearing members 65 which are mounted at opposite ends of shoulder member 16 and are preferably spaced apart about 11 inches. Each bearing member 65 includes four nylon rollers 64 about 1 ¼ inches in diameter and 9/16 inches wide. The rollers are rotatably positioned equidistantly from each other at the corners of bearing members 65 and engage the outer surface of arm member 18. Bearing members 65 enable sliding joint 44 to be a low friction sliding joint. A front stop 104 and a rear stop 106 are positioned on arm member 18 to allow about 40" of travel and prevents the arm member 18 from sliding out of sliding joint 44 by engaging against rollers 64. Although bearing members 65 have been shown to have four rollers 64, alternatively, bearing members 65 can have as little as three rollers or more than four rollers. In addition, rollers 64 can have a contoured surface to more securely engage the outer surface of arm member 18. Furthermore, the dimensions of rollers 64 can be varied and other suitable materials can be employed such as other plastics, rubber or metal.

Figure 8:
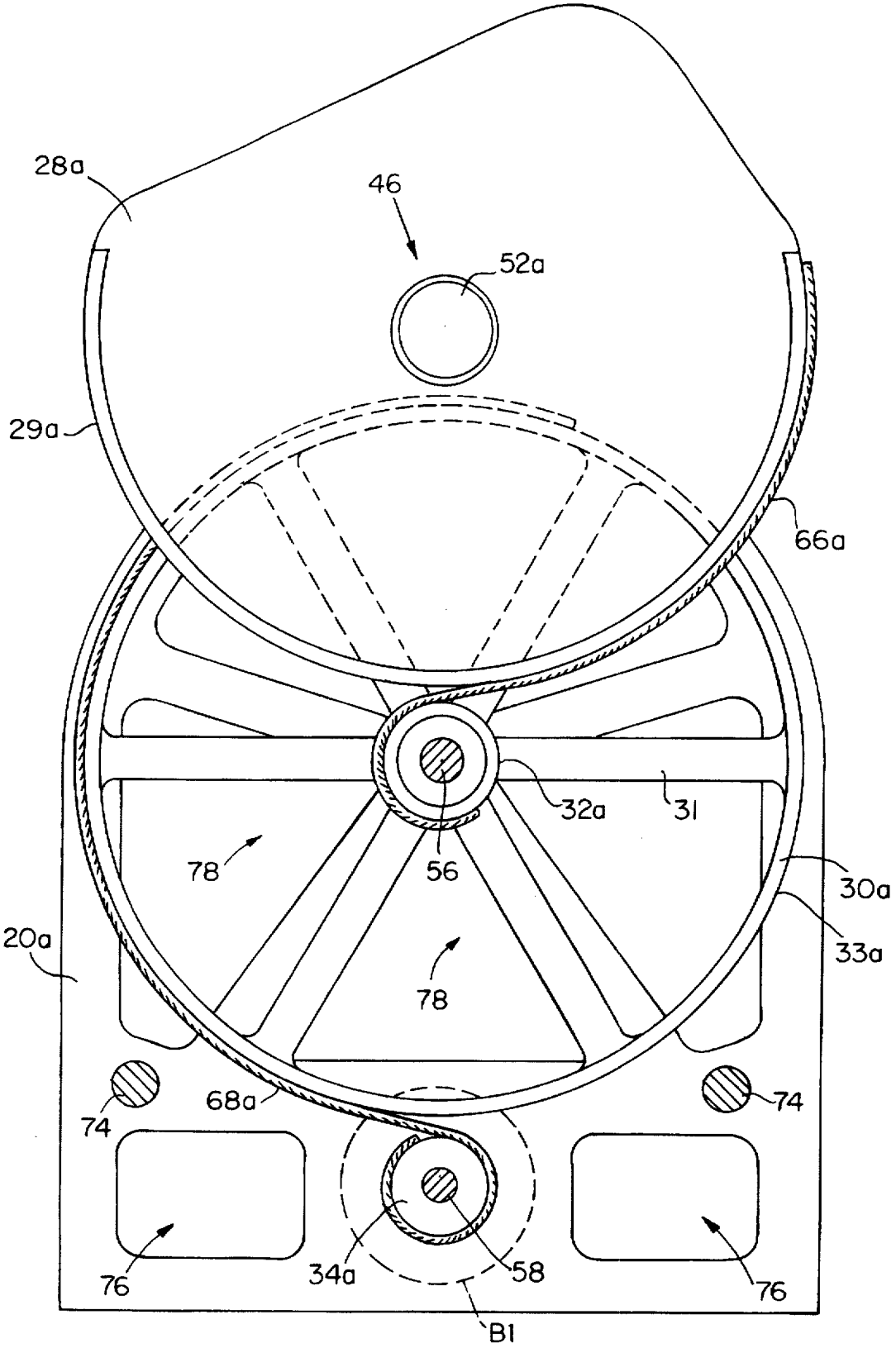
FIG. 8 is a side sectional view of the turret showing the cabling arrangement on one side of the turret.

Shoulder member 16 includes two side plates **28*a* and 28*b* which are spaced apart from each other by bearing members 65, three tie rods 15 and a bottom plate (not shown) extending between the bottoms of bearing members 65. Shoulder member 16 is rotatably mounted to turret 14 along rotary shoulder joint 46 by two shafts 52*a* and 52*b* which extend from side plates 28*a*/28*b*. Shafts 52*a*/52*b* are supported within the side members 20*a*/20*b* of turret 14 by roller bearings 86. Side plates 28*a*/28*b* are each preferably made of two pieces, an upper and lower piece. The lower portions of side plates 28*a*/28*b* have outer rims 29*a* and 29*b* which extend in a semi-circle about rotary shoulder joint 46** to form a pulley which is preferably about 15 ⅝ inches in diameter and ⅞ inches wide (FIG. 8).

Transmission T3 includes a brake pulley 26 which is mounted to the brake shaft 50 of brake B3. Brake B3 is mounted to side plate **28*b* with brake shaft 50 extending to side plate 28*a* where it is rotatably supported by a bearing 51. Transmission T3 further includes two cables 27 which are preferably about 2.4 mm in diameter and have less than 5 mm of deflection for a load of 500N. One cable 27 extends along arm member 18 from end stop 106 to brake pulley 26. The second cable 27 extends along arm member 18 from end plate 108 to brake pulley 26. The two cables 27 engage and wrap around brake pulley 26 in antagonistic directions (see FIG. 6) and are fixed thereon. Linear motion of arm member 18 relative to shoulder member 16 causes cables 27 to rotate brake pulley 26 and brake shaft 50. Sensor S3 is mounted to side plate 28***a* near the end of brake shaft 50 and senses the rotational displacement of brake shaft 50. Sensor S3 provides signals of brake shaft 50 proportional to the rotational displacement of brake shaft 50 to computer 110 which controls the level of resistance of brake B3. The resistance provided by brake B3 is proportional to the rotational velocity of brake shaft 50 to brake the rotation. Brake pulley 26 is preferably about 2⅝ inches in diameter and is capable of converting longitudinal forces on arm member 18 of up to 500N into torques on brake shaft 50 of up to 17 N-m. A wear band 27*a* is preferably provided underneath cables 27 along the travel portion of arm member 18 for dampening resonances and providing wear protection of arm member 18.

Turret 14 includes side members 20*a*/20*b* which are mounted to a support plate 22. Side members 20*a*/20*b* are further strengthened by support brackets 24*a* and 24*b* respectively, which provide lateral support. Side members 20*a*/20*b* include open portions 76 and 78 (FIG. 8) which minimizes the weight of turret 14.

Figure 7:
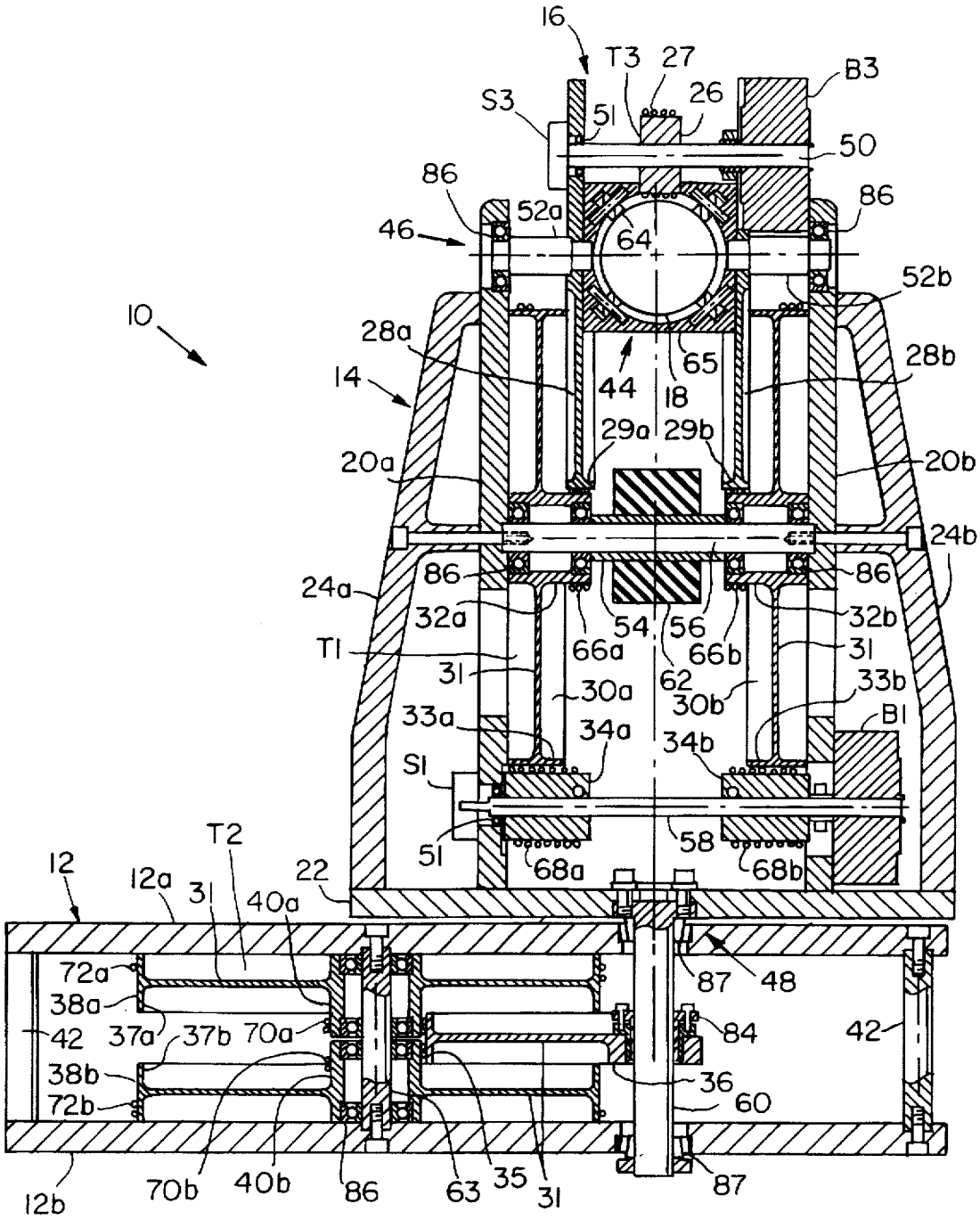
FIG. 7 is a front sectional view of the present invention exercise apparatus.

Transmission T1 is a two stage torque reduction cable drive transmission located within turret 14 which couples rotary shoulder joint 46 to brake B1. Transmission T1 includes two turret pulleys 30*a* and 30*b* which are rotatably mounted to side members 20*a*/20*b* along a shaft 56 with ball bearings 86 (FIG. 7). Pulleys 30*a*/30*b* have outer rims 33*a* and 33*b*, respectively, as well as hubs 32*a* and 32*b* which extend inwardly towards each other. The hubs 32*a*/32*b* are connected to their respective outer rims 33*a*/33*b* by spokes 31 (FIG. 8). Pulleys 30*a*/30*b* are preferably about 15¼ inches in diameter and are about 2 inches wide. Hubs 32*a*/32*b* are preferably about 3 inches in diameter with the outer surfaces being grooved to ensure that cables will wind on them in an orderly fashion. Pulleys 30*a*/30*b* are spaced apart by a spacer 54. A rubber roller 62 is mounted to spacer 54 and serves as a pitch axis stop to prevent shoulder member 16 from over pivoting. Transmission T1 also includes brake pulleys 34*a* and 34*b* which are supported by a brake shaft 58 extending from brake B1. Brake pulleys 34*a*/34*b* are preferably about 2 ¼ inches in diameter by 3 inches long and have grooved outer surfaces for winding cable in an orderly fashion. Brake B1 is mounted to side member 20*b* and shaft 58 is supported at side member 20*a* by a roller bearing 51. Sensor S1 is mounted to side member 20*a* and is positioned at the end of brake shaft 58 for sensing the rotational displacement of brake shaft 58.

In the first stage of transmission T1, cables 66*a* and 66*b* which preferably have diameters of 3.2 mm are fixed to opposing sides of the outer rims 29*a*/29*b* of side plates 28*a*/28*b* and wrap around a portion of the outer rims 29*a*/29*b* before engaging respective hubs 32*a*/32*b* of pulleys 30*a*/30*b*. Cables 66*a*/66*b* wrap around hubs 32*a*/32*b* in opposing directions and are fixed to the hubs 32*a*/32*b*. As a result, rotation of shoulder member 16 about rotary shoulder joint 46 in either direction causes the rotation of a pulley 30*a* or 30*b*. This first stage of transmission T1 preferably provides about a 5 to 1 torque reduction between outer rims 29*a*/29*b* and hubs 32*a*/32*b*.

In the second stage of transmission T1, cables 68*a* and 68*b* which are preferably 2.4 mm in diameter are attached to the outer rims 33*a*/33*b* of pulleys 30*a*/30*b*. Cables 68*a*/68*b* wrap around the outer rims 33*a*/33*b* in opposing directions and engage respective brake pulleys 34*a*/34*b*. Cables 68*a*/68*b* wrap around brake pulleys 34*a*/34*b* in opposing directions and are fixed to the brake pulleys. This second stage of transmission T1 preferably provides about a 6.5 to 1 torque reduction with the total torque reduction of the two stages of transmission T1 preferably being about 32.5 to 1.

FIG. 8 depicts the cabling scheme for cables 66*a* and 68*a*. Cable 66*a* wraps around the outer rim 29*a* of side member 28*a* and hub 32*a* in the opposite direction that cable 68*a* wraps around the outer rim 33*a* of pulley 30*a* and brake pulley 34*a* such that brake shaft 58 will rotate in the same direction that rotary shoulder joint 46 is rotated. The cabling scheme for cables 66*b* and 68*b* is the same but are in the opposite direction. By having cables wrap around brake pulleys 34*a* and 34*b* in opposing directions, brake shaft 58 can be rotated in both rotational directions upon rotation of shoulder member 16 about rotary shoulder joint 46.

Referring to FIGS. 4 and 7, rotary waist joint 48 rotatably couples turret 14 to base 12 and includes a shaft 60 extending downwardly from support plate 22. Shaft 60 is supported by bearings 87 which are housed in the upper plate 12*a* and lower plate 12*b* of base 12. Upper plate 12*a* and lower plate 12*b* are spaced apart from each other by a series of connecting rods 42 located along the perimeter of the upper and lower plates 12*a*/12*b*.

Transmission T2 is a two stage torque reduction cable drive transmission located within base 12 which couples rotary waist joint 48 to brake B2. Transmission T2 includes a turret output pulley 36 which is fixed to shaft 60. Output pulley 36 has a semi-circular outer rim 35 which is connected to the inner hub by spokes 31. Outer rim 35 preferably has a diameter of about 15 ⅝ inches and is about 1 ⅝ inches wide. A horizontally positioned upper base pulley 38*a* and a horizontally position lower base pulley 38*b* are rotatably mounted to base 12 by a shaft 63 and four bearings 86. Pulleys 38*a*/38*b* are similar to and have the same dimensions as turret pulleys 30*a*/30*b*. Pulleys 38*a*/38*b* straddle output pulley 36 and have respective hubs 40*a* and 40*b* which extend inwardly towards each other. Brake B2 is mounted to the underside of lower plate 12*b*. Brake shaft 82 extends from brake B2 to upper plate 12*a* and where it is supported by bearing 51. Two brake pulleys 80*a* and 80*b* are mounted to brake shaft 82. Brake pulleys 80*a*/80*b* are similar to and have the same dimensions as brake pulleys 34*a*/34*b*. Sensor S2 is mounted to upper plate 12*a* and is positioned at the end of brake shaft 82 for sensing the rotational displacement of brake shaft 82.

In the first stage of transmission T2, output pulley 36 has two cables 70*a* and 70*b* preferably having diameters of 3.2 mm which are fixed to opposite sides of the pulley and wrap about the outer rim 35 in opposing directions. Cable 70*a* engages hub 40*a* of upper base pulley 38*a* and cable 70*b* engages the hub 40*b* of lower base pulley 38*b*. Cables 70*a*/70*b* wrap around hubs 40*a*/40*b* in opposing directions and are fixed to hubs 40*a*/40*b*.

In the second stage of transmission T2, cables 72*a* and 72*b* which are preferably 2.4 mm in diameter are fixed to the outer rims 37*a* and 37*b* of pulleys 38*a*/38*b*. Cables 72*a*/72*b* wrap about the outer rims 37*a*/37*b* in opposite directions and engage brake pulleys 80*a*/80*b* respectively. Cables 72*a*/72*b* wrap in opposite directions about brake pulleys 80*a*/80*b* and are fixed thereon. The torque ratio reduction for each stage of transmission T2 is preferably the same as in transmission T1 resulting in a total torque reduction of preferably about 32.5 to 1.

Figure 9:
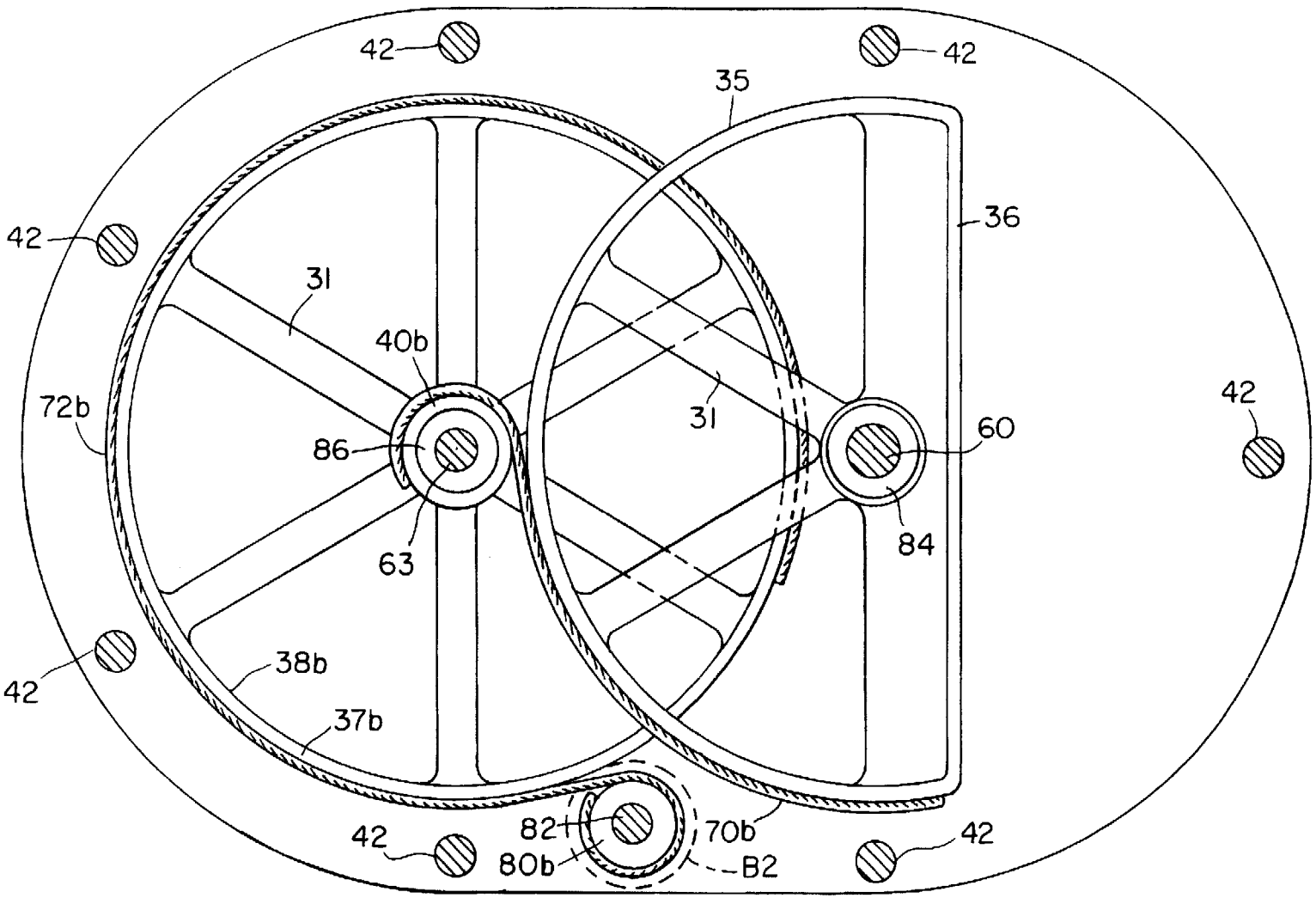
FIG. 9 is a cross-sectional view of the base showing the cabling arrangement on the bottom portion of the base.

FIG. 9 depicts the cabling scheme for cables 70b and 72b. Cable 70b wraps around the outer rim 35 of pulley 36 and hub 40b in the opposite direction that cable 72b wraps around the outer rim 37b of pulley 38b and brake pulley 80b such that brake shaft 82 will rotate in the same direction that rotary waist joint 48 is rotated. The cabling scheme for cables 70a and 72a are similar but are in the opposite direction. By having cables wrap around brake pulleys 80a/80b in opposing directions, brake shaft 82 can be rotated in both rotational directions upon rotation of turret 14 about rotary waist joint 48.

Figure 10:
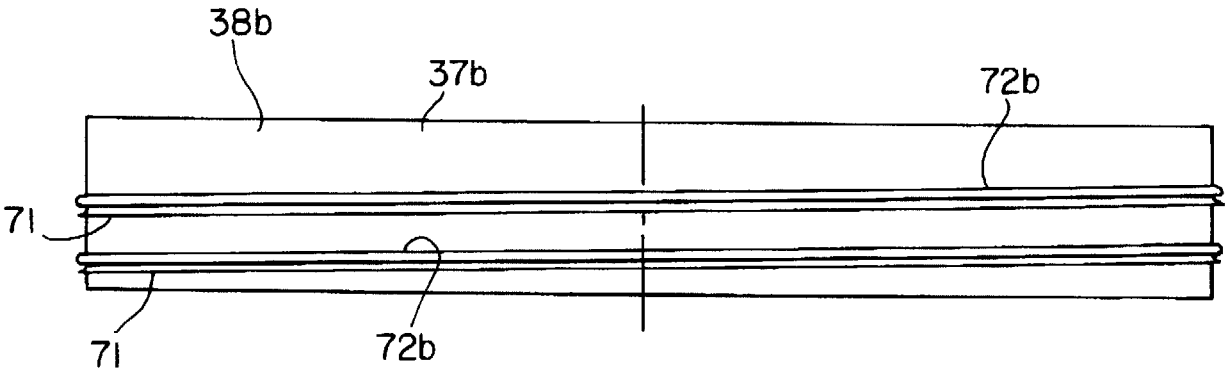
FIG. 10 is a side view of the lower base pulley showing the helical cable support.

FIG. 10 depicts the cable support scheme for pulley 38b. Pulley 38b includes a guide wire 71 wrapped around and bonded to the outer rim 37b in a helix. The guide wire 71 supports the lower surface of cable 72b and prevents cable 72b from sliding off the pulley 38b. Pulleys 36 and 38a also include a guide wire 71 wrapped about the outer rims in a similar fashion for supporting and preventing cables 70a, 70b and 72a from slipping off.

Most of the components of exercise apparatus 10 are preferably made of aluminum to minimize the inertia of the apparatus. The low inertia of exercise apparatus 10 together with the low friction and zero backlash of transmissions T1, T2 and T3 allows exercise apparatus 10 to operate effectively.

Figure 11:
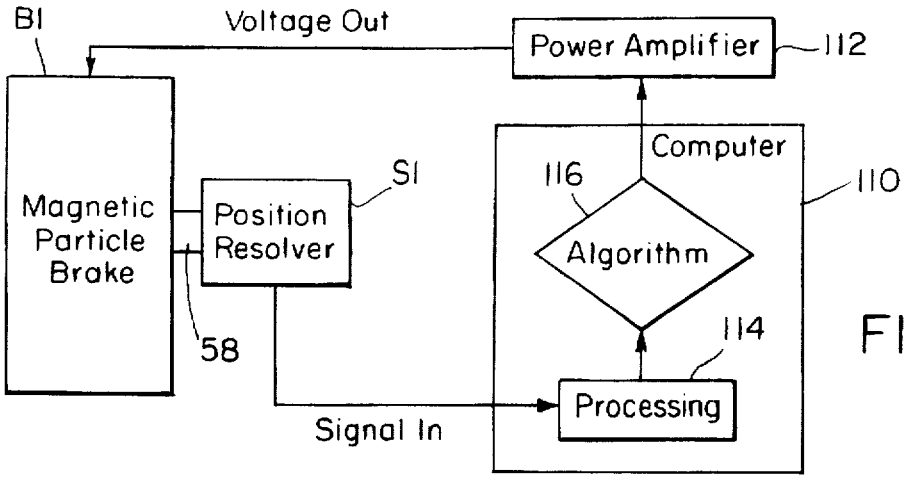
FIG. 11 is a schematic drawing of the control scheme for one of the brakes.

FIG. 11 depicts a preferred method for controlling brakes B1, B2 and B3. Although the diagram of FIG. 11 depicts brake B1, the control format for brakes B2 and B3 are similar. When rotary shoulder joint 46 is rotated, transmission T1 causes brake shaft 58 to rotate and the rotation of brake shaft 58 is sensed by sensor S1. A signal proportional to the rate of rotational displacement of brake shaft 58 is provided to computer 110. Computer 110 executes a processing step 114 to convert the rotational displacement into rotational velocity and then runs an algorithm step 116 to determine the signal necessary for controlling brake B1 for resisting that rotational velocity. This signal is sent to power amplifier 112 which amplifies the signal. The amplified signal is then sent to brake B1 which provides the appropriate resistance for the signal received. The faster brake shaft 58 turns the more resistance is provided by brake B1.

Figure 12:
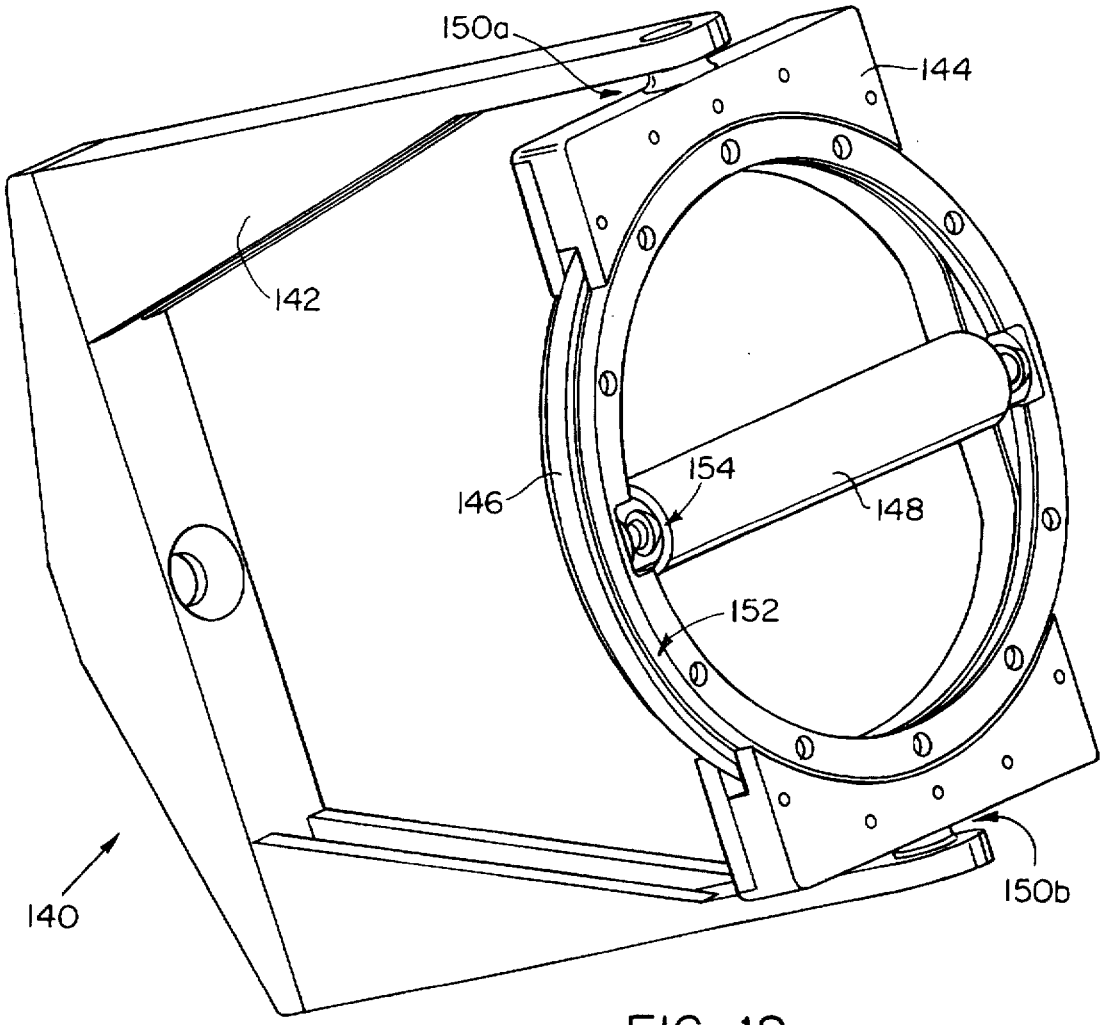
FIG. 12 is a perspective view of another preferred limb interface.

FIG. 12 depicts another preferred limb interface 140. Limb interface 140 includes an outer yoke 142 which is mounted to arm member 18. An inner frame 144 is rotatably mounted to outer yoke 142 by joints 150a and 150b. A bearing 146 is mounted to inner frame 144 providing a rotary joint 152 which is orthogonal to rotary joints 150a and 150b. A handle 148 is rotatably mounted within bearing 146 along rotary joint 154. Limb interface 8 provides three unbraked rotational degrees of freedom.

Figure 13:
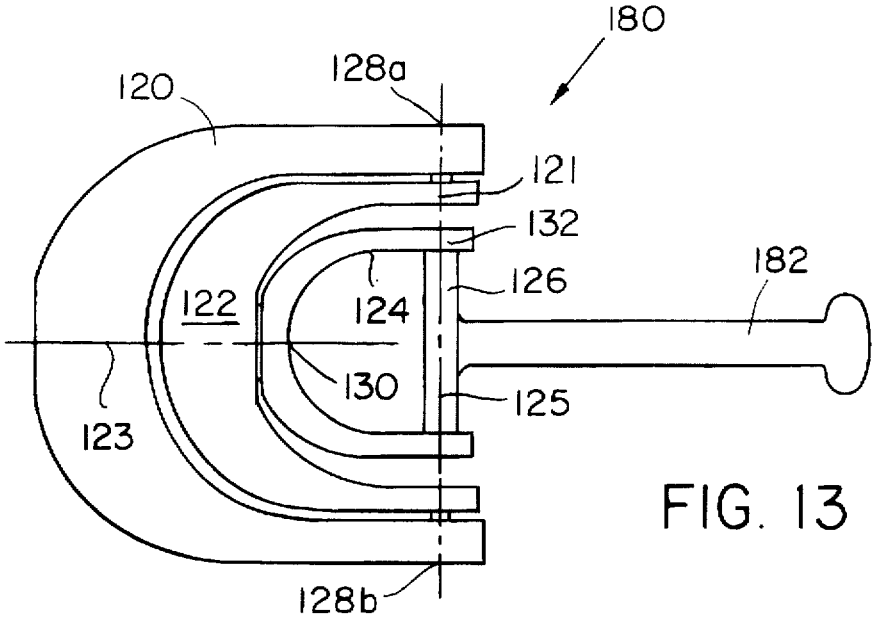
FIGS. 13, 14 and 15 are side views of still other preferred limb interfaces.

FIG. 13 depicts another preferred limb interface 180. Limb interface differs from limb interface 8 in that a handle of a baseball bat 182 is fixed to handle 126 in order to allow exercising of a bat swinging motion. In such an exercise, computer 110 can be programmed such that exercise apparatus 10 provides resistance in the forward swing only. The resistance can also be greatest at a position simulating the point of impact with a baseball. In addition, other types of handles can be fixed to handle 126 such as a hockey stick handle, golf club handle, tennis racket handle, etc. Furthermore, such handles can be fixed to handle 148 of limb interface 140.

Figure 14:
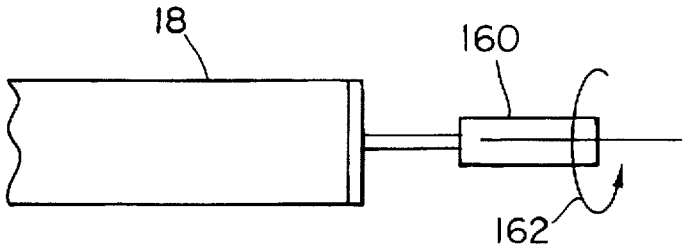
Figure 15:
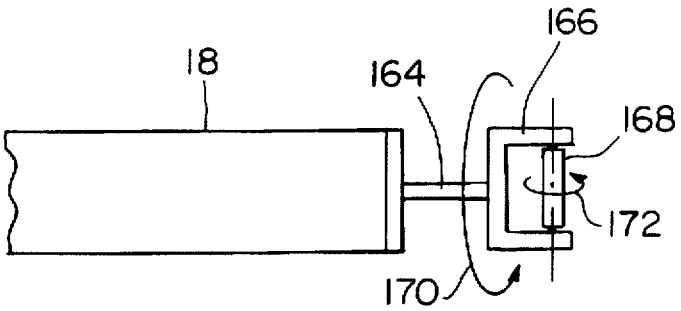

FIGS. 14 and 15 depict other preferred limb interfaces. Referring To FIG. 14, limb interface 160 includes a handle that is rotatable only about a single axis as indicated by arrow 162. A user grasping limb interface 160 can exercise, for example, a rowing motion. Referring to FIG. 15, limb interface 164 provides two rotational degrees of freedom. Limb interface 164 includes a yoke 166 and a handle 168 each of which are rotatable about a separate axis as depicted by arrows 170 and 172.

Although exercise apparatus 10 has been described for performing exercises, apparatus 10 can also be employed with interactive video games or virtual reality applications. In such uses, complex resistance areas can be programmed into computer 110 to make the experience seem realistic or more exciting. In addition, although exercise apparatus 10 has been described to provide resistance that is proportional to the speed at which joints 44, 46 and 48 move, in other preferred embodiments, exercise apparatus 10 can be programmed to provide constant force resistance or resistance having a load profile which varies depending upon position, velocity or direction.

For example, a virtual object best described as a "sticky box with marshmallow filling" can be located within the work space. Outside the object, the user is free to move and find the outer surfaces of the object. Once the outer surface is found, the user sticks to the outer surface but with effort, can either pull away from the outer surface or push through the viscous center where the resisting force is proportional to the speed.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. For example, although particular dimensions for the components of one preferred embodiment have been specified, such dimensions can vary for a number of reasons such as different sizes of the exercise apparatus or different ratios needed for transmissions T1, T2 or T3. Torque reduction ratios of transmissions T1, T2 and T3 can be lower if brakes capable of resisting more than 17 N-m are employed. In addition, although computer controlled particle brakes are preferred, mechanically adjusted brakes can be employed. Furthermore, although the joints of the limb interfaces are preferably unbraked, selected joints of the limb interfaces can be braked. The limb interfaces can also be attached to the legs, elbows, head and torso of the user. In such cases, appropriate modifications to the limb interface are required. Also, although exercise apparatus 10 is shown to be positioned on a floor stand, alternatively, the present invention exercise apparatus can be suspended upside down or positioned sideways.

What is claimed is:

1. A passive exercise apparatus comprising:

an interface member for coupling to a user's body;

an arm member coupled to the interface member by a wrist joint, the wrist joint having rotational motion about three axes;

a first link coupled to the arm member by a sliding joint, the sliding joint allowing translational motion of the arm member relative to the first link;

a second link rotatably coupled to the first link by a first rotary joint;

a third link rotatably coupled to the second link by a second rotary joint;

a first rotary brake coupled to the first rotary joint for resisting movement of the first rotary joint, a first transmission coupled between the first joint and the first brake for reducing torque to the first brake, the first link having an outer periphery, a portion of the outer periphery of the first link forming a pulley that is part of the first transmission;

a second rotary brake coupled to the second rotary joint for resisting movement of the second rotary joint, a second transmission coupled between the second joint and the second brake for reducing torque to the second brake; and a third rotary brake coupled to the arm member for resisting translational motion of the arm member, a third transmission coupled between the arm member and the third brake for reducing torque to the third brake, wherein the user may interface with the apparatus to exercise a six degree of freedom motion.

2. The apparatus of claim 1 in which the wrist joint is unbraked.

3. The apparatus of claim 1 in which the ratio of the first transmission is about 30:1 or greater.

4. The apparatus of claim 3 in which the first transmission comprises a two-stage cable drive.

5. The apparatus of claim 1 in which the ratio of the second transmission is about 30:1 or greater.

6. The apparatus of claim 5 in which the second transmission comprises a two-stage cable drive.

7. The apparatus of claim 6 in which the second transmission includes at least one horizontally oriented pulley for engaging a cable, said pulley having a wire encircling the pulley in a helix for vertically supporting said cable to prevent said cable from slipping off said pulley.

8. The apparatus of claim 1 in which the third transmission coupled between the arm member and the third brake comprises:

a cable secured to the arm member; and a pulley rotatably coupled to the third brake, said cable rotatably engaging the pulley.

9. The apparatus of claim 1 further comprising first, second and third sensors for sensing movement of the first rotary joint, second rotary joint and the arm member respectively, said sensed movement being provided to a controller, the controller controlling the amount of resistance provided by the first, second and third brakes, said resistance being proportional to the movement sensed by the sensors.

10. The apparatus of claim 9 wherein the arm member, the first link and the second link are arranged to allow movement of the interface member in a three dimensional resistance field.

11. The apparatus of claim 9 in which the controller provides the resistance field with first and second resistance areas, wherein the level of resistance provided by the first area differs from the level of resistance provided by the second area.

12. The apparatus of claim 11 in which the first and second resistance areas each have a shape that can be varied by the controller.

13. A passive exercise apparatus comprising:

an interface member for coupling to a user's body;

an arm member coupled to the interface member by a wrist joint, the wrist joint being an unbraked joint having rotational motion about three axes;

first link coupled to the arm member by a sliding joint, the sliding joint allowing translational motion of the arm member relative to the first link;

a second link rotatably coupled to the first link by a first rotary joint;

a third link rotatably coupled to the second link by a second rotary joint;

a first rotary brake coupled to the first rotary joint for resisting movement of the first rotary joint;

a second rotary brake coupled to the second rotary joint for resisting movement of the second rotary joint;

a third rotary brake coupled to the arm member for resisting translational motion of the arm member;

a first transmission coupled between the first joint and the first brake for reducing torque to the first brake, the first link having an outer periphery, a portion of the outer periphery of the first link forming a pulley that is part of the first transmission;

a second transmission coupled between the second joint and the second brake for reducing torque to the second brake; and a third transmission coupled between the arm member and the third brake for reducing torque to the third brake, wherein the user may interface with the apparatus to exercise a six degree of freedom motion, while only three degrees of freedom of the apparatus are braked.

14. The apparatus of claim 13 further comprising first, second and third sensors for sensing movement of the first rotary joint, second rotary joint and the arm member respectively, said sensed movement being provided to a controller, the controller controlling the amount of resistance provided by the first, second and third brakes, said resistance being proportional to the movement sensed by the sensors.

15. A method of exercising comprising the steps of:

coupling an interface member of an exercise apparatus to a user's body, the interface member being coupled to an arm member by a wrist joint, the wrist joint providing rotational motion about three axes, the arm member being coupled to a first link by a sliding joint, the sliding joint allowing translational motion of the arm member relative to the first link, a second link being rotatably coupled to the first link by a first rotary joint and a third link being rotatably coupled to the second link by a second rotary joint;

moving the limb in a desired motion relative to the exercise apparatus;

resisting movement of the first rotary joint with a first rotary brake coupled to the first rotary joint, a first transmission being coupled between the first rotary joint and the first brake for reducing the amount of torque to the first brake, the first link having an outer periphery, a portion of the outer periphery of the first link forming a pulley that is part of the first transmission;

resisting movement of the second rotary joint with a second rotary brake coupled to the second rotary joint, a second transmission being coupled between the second rotary joint and the second brake for reducing the amount of torque to the second brake; and resisting movement of the arm member with a third rotary brake coupled to the arm member, a third transmission being coupled between the arm member and the third brake for reducing the amount of torque to the third brake, wherein the user may interface with the apparatus to exercise a six degree of freedom motion.

16. The method of claim 15 further comprising the steps of:

sensing movement of the first rotary joint, second rotary joint and arm member with first, second and third sensors, respectively;

providing said sensed movement to a controller; and controlling the amount of resistance provided by the first, second and third brakes with the controller, the amount of resistance provided by each brake being proportional to the movement sensed by the sensors.

17. The method of claim 15 further comprising the step of arranging the arm member, the first link and the second link to allow movement of the interface member in a three dimensional resistance field.

18. The method of claim 17 further comprising the steps of:

providing a first resistance area and a second resistance area within the resistance field with a controller, the level of resistance provided by the first resistance area differing from the level of resistance provided by the second resistance area.

19. The method of claim 18 further comprising the step of shaping the first and second resistance areas with the controller.

* * * * *